US011642684B2

(12) United States Patent
Cheng

(10) Patent No.: US 11,642,684 B2
(45) Date of Patent: May 9, 2023

(54) WATER SPRAY GUN FOR CONTROL OF OUTFLOW OF WATER AND ADJUSTMENT OF OUTFLOW

(71) Applicant: YUAN-MEI CORP., Changhua County (TW)

(72) Inventor: Chi-Han Cheng, Changhua County (TW)

(73) Assignee: YUAN-MEI CORP., Changhua County (TW)

( * ) Notice: Subject to any disclaimer, the term of this patent is extended or adjusted under 35 U.S.C. 154(b) by 419 days.

(21) Appl. No.: 16/879,687

(22) Filed: May 20, 2020

(65) Prior Publication Data

US 2021/0362176 A1 Nov. 25, 2021

(51) Int. Cl.
*B05B 12/00* (2018.01)
*B05B 1/30* (2006.01)

(52) U.S. Cl.
CPC ..... *B05B 12/002* (2013.01); *B05B 1/3013* (2013.01); *B05B 1/3046* (2013.01); *B05B 12/0022* (2018.08)

(58) Field of Classification Search
CPC ..... B05B 1/30; B05B 1/3013; B05B 1/3046; B05B 9/01; B05B 12/002; B05B 12/0022; B05B 12/0026
USPC ..... 239/526
See application file for complete search history.

(56) References Cited

U.S. PATENT DOCUMENTS 2,937,813 A * 5/1960 Rinkewich ..... B05B 1/308 239/459
4,448,355 A * 5/1984 Roman ..... B05B 9/01 239/526
4,534,512 A * 8/1985 Chow ..... B05B 1/1654 239/394
6,279,839 B1 * 8/2001 Chang ..... B05B 1/3046 239/525
6,427,931 B1 * 8/2002 Guo ..... B05B 1/30 239/526
2005/0001070 A1 * 1/2005 Wu ..... B05B 1/3013 239/526
2007/0278442 A1 * 12/2007 Wang ..... B05B 1/3013 251/231
2008/0245900 A1 * 10/2008 Chih ..... B05B 1/3013 239/526
2012/0298778 A1 * 11/2012 Chen ..... B05B 12/0024 239/394
2013/0015271 A1 * 1/2013 Chen ..... B05B 11/1046 239/526
2013/0193236 A1 * 8/2013 Ye ..... B05B 9/01 239/526

(Continued)

*Primary Examiner* — Jason J Boeckmann
(74) *Attorney, Agent, or Firm* — Che-Yang Chen; Law Office of Michael Chen

(57) ABSTRACT

A water spray gun for control of an outflow of water and adjustment of the amount of the outflow is revealed. The water spray gun includes a handle portion, a pipe portion connected to the handle portion and used for spraying water, and a control device arranged at the position where the pipe portion meets the handle portion. The control device comprises a press part and a rotary control member. The amount of the water outflow is controlled by the rotary control member. The amount of the outflow sprayed out from the pipe portion at respective stages is continuously controlled and regulated by the control device.

6 Claims, 11 Drawing Sheets

(56) References Cited

U.S. PATENT DOCUMENTS

| | | | | |
|---|---|---|---|---|
| 2015/0028134 | A1* | 1/2015 | Hung | B05B 12/0022 239/526 |
| 2015/0034740 | A1* | 2/2015 | Su | B05B 12/0024 239/526 |

* cited by examiner

WATER SPRAY GUN FOR CONTROL OF OUTFLOW OF WATER AND ADJUSTMENT OF OUTFLOW

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to a water spray gun, especially to a water spray gun with a control device for control of an outflow of water and adjustment of the amount of the outflow by selecting different amount of the water outflow at various stages.

Description of Related Arts

Generally, a conventional water spray gun includes two members-a control member for adjustment of the amount of water sprayed and a fixing member for fixing the outflow control member, separated from each other. Referring to Taiwanese Pat. Pub. No. 203775, a water spray gun with flow regulation is revealed. The control member for flow regulation includes a water-control valve stem, a valve stem spring, and an adjusting nut. The water-control valve stem is driven to move by rotation of the adjusting nut. With reference to Taiwanese Pat. No. M293796, crack resistant structure of water spray gun is revealed. The water spray gun includes a control member pivotally connected to an outer surface of a frame, a spray head connected to the frame and having a chamber with an water passage opening communicating with a water outlet of the frame, a piston movably mounted in the chamber and provided with a through hole and a seal ring therearound for abutting against an inner wall of the chamber, a movable valve stem disposed in a water channel of the frame and having one end inserted out of the frame to be connected to the control member and a stopper end on the other end, and a restoring spring arranged at the chamber of the spray head and having one end thereof abutting against the piston. A support spring is disposed between the movable valve stem and the frame to push the movable valve stem and allow the stopper end to be mounted into the through hole of the piston for waterproofing. As shown in figures, a press part is arranged at an outer surface of the frame. The press part and a water control valve of the frame are connected to each other and provided with an adjustment member and a positioning member. The adjustment member and the positioning member are two control members arranged separately. The adjustment member is used to adjust the amount of water outflow while the positioning member is used for control of continuous water outflow. Thus users need to operate the respective control members separately for adjustment of the amount of the water outflow and control of continuous water outflow. There is room for improvement and there is a need to provide a water spray gun which overcomes the above shortcoming.

SUMMARY OF THE PRESENT INVENTION

Therefore it is a primary object of the present invention to provide a water spray gun in which two control members are integrated into one control part for control of an outflow of water and adjustment of the amount of the outflow by only a single operation of the control member.

In order to achieve the above object, a water spray gun for control of an outflow of water and adjustment of the amount of the outflow according to the present invention includes a handle portion, a pipe portion connected to the handle portion and used for spraying water, a control device arranged at the position where the pipe portion meets the handle portion, and a movable valve stem. A water inlet channel of the handle portion is communicating with a water outlet channel of the pipe portion. The movable valve stem is mounted in the water outlet channel. The control device comprises a rotary control member provided with a plurality of step-like parts and a press part having one end connected to one end of the movable valve stem. The press part is further provided with a positioning part corresponding to the step-like parts of the rotary control member. The rotary control member is rotated to select one of the step-like parts corresponding to the positioning part for adjusting the movable valve stem to move forward or backward axially. Thus a gap for the water outflow is further adjusted finely. Thereby the amount of the outflow from the water outlet channel is under control and multi-stage outflow from the pipe portion is achieved.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENT

Figure 7:
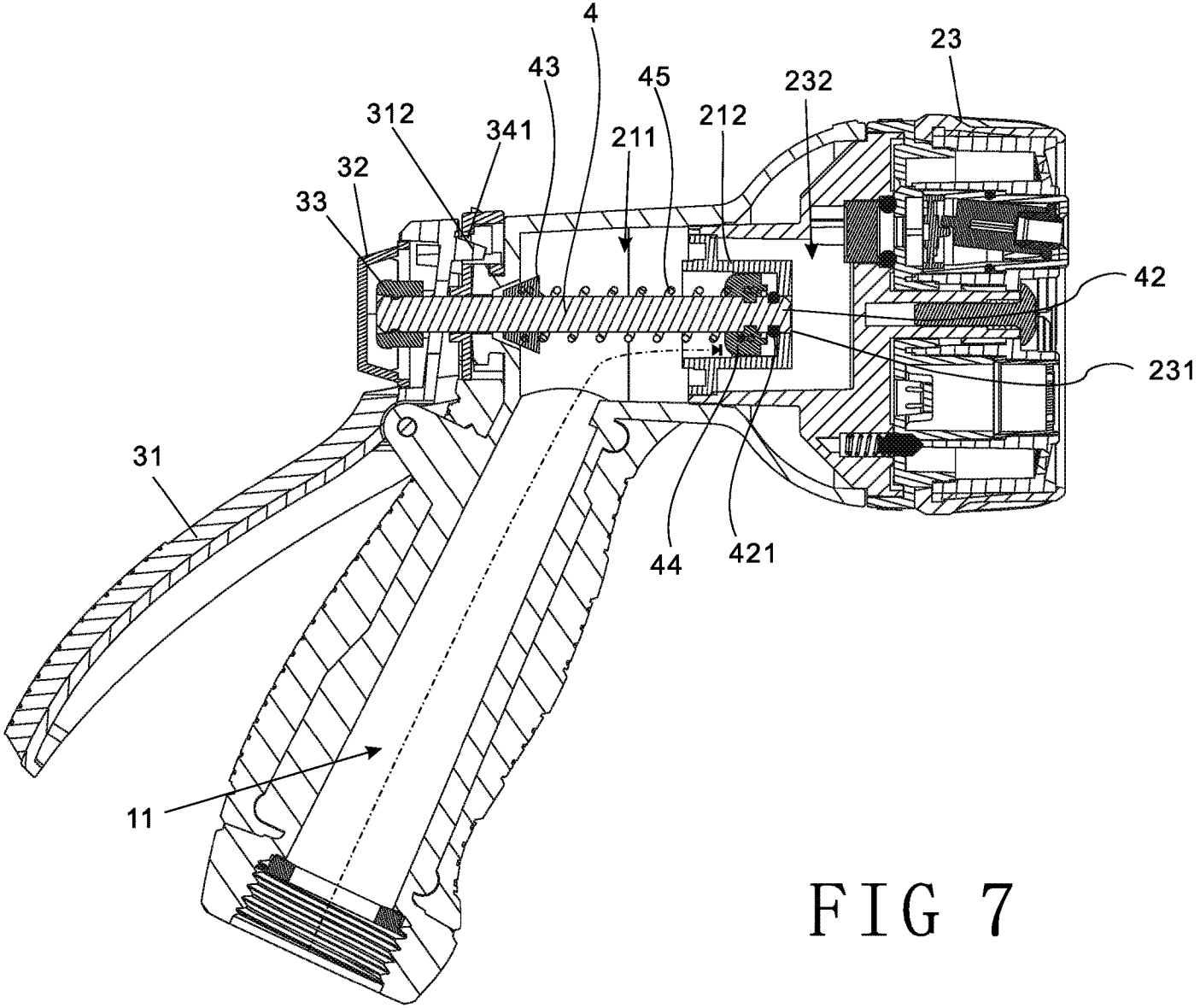
FIG. 7 is a sectional view of an embodiment in a closed state without outflow according to the present invention.

Referring to FIG. 1-4, a water spray gun for control of an outflow of water and adjustment of the amount of the outflow includes a handle portion 1, a pipe portion 2 for spraying water, a control device 3 and a movable valve stem 4. The pipe portion 2 includes a pipe body 21 with a water outlet channel, a through hole 22 arranged at a tail end thereof, and a spray head 23 disposed on a front end thereof. The water outlet channel of the pipe body 21 is separated into a first chamber 211 and a second chamber 232 by a partition 212 while the partition 212 is provided with a passage 231, as shown in FIG. 7. The through hole 22 is communicating with the first chamber 211. The movable valve stem 4 is mounted in the first chamber 211 and is composed of a first end 41, a second end 42 formed by extension of the first end 41, a sleeve part 43 disposed on the first end 41, an enlarged member 44 arranged close to the second end 42, and a spring 45. The second end 42 is projecting from the enlarged member 44 and a seal ring 421 is fit on the second end 42 while the spring 45 is set between the first end 41 and the second end 42. The second end 42 with the right shape just fits the passage 231 and the second end 42 can be mounted into the passage 231 closely and the passage 231 is sealed by the seal ring 421.

The pipe portion 2 is connected to the handle portion 1 while the control device 3 is disposed on the position where the pipe portion 2 meets the handle portion 1. The handle portion 1 is provided with a water inlet channel 11 which is connected to and communicating with the water outlet channel of the pipe portion 2.

As to the control device 3, it comprises a press part 31, a cover part 32, a limit member 33 and a rotary control member 34. The press part 31 includes an assembly end 311, a positioning part 312 and an insertion hole 313. The assembly end 311 has one end pivotally connected to the handle portion 1 while the positioning part 312 is disposed on one side of the assembly end 311 facing and corresponding to the rotary control member 34. The rotary control member 34 comprises a slot 341, an axial hole 346, a push part 347, and a plurality of step-like parts 342, 343, 344, 345. The number of the step-like parts is not limited. In this embodiment, the step-like parts include a first step-like part 342, a second step-like part 343, a third step-like part 344 and a fourth step-like part 345. There are at least two step-like parts and the height of the fourth step-like part 345 is larger than that of the third step-like part 344 while the height of the third step-like part 344 is larger than that of the second step-like part 343. Similarly, the height of the second step-like part 343 is larger than that of the first step-like part 342. Briefly, the height of the respective step-like parts is increased in turn. There is at least one push part 347 disposed on one side of the rotary control member 34 for allowing users to adjust and rotate the rotary control member 34.

Figure 1:
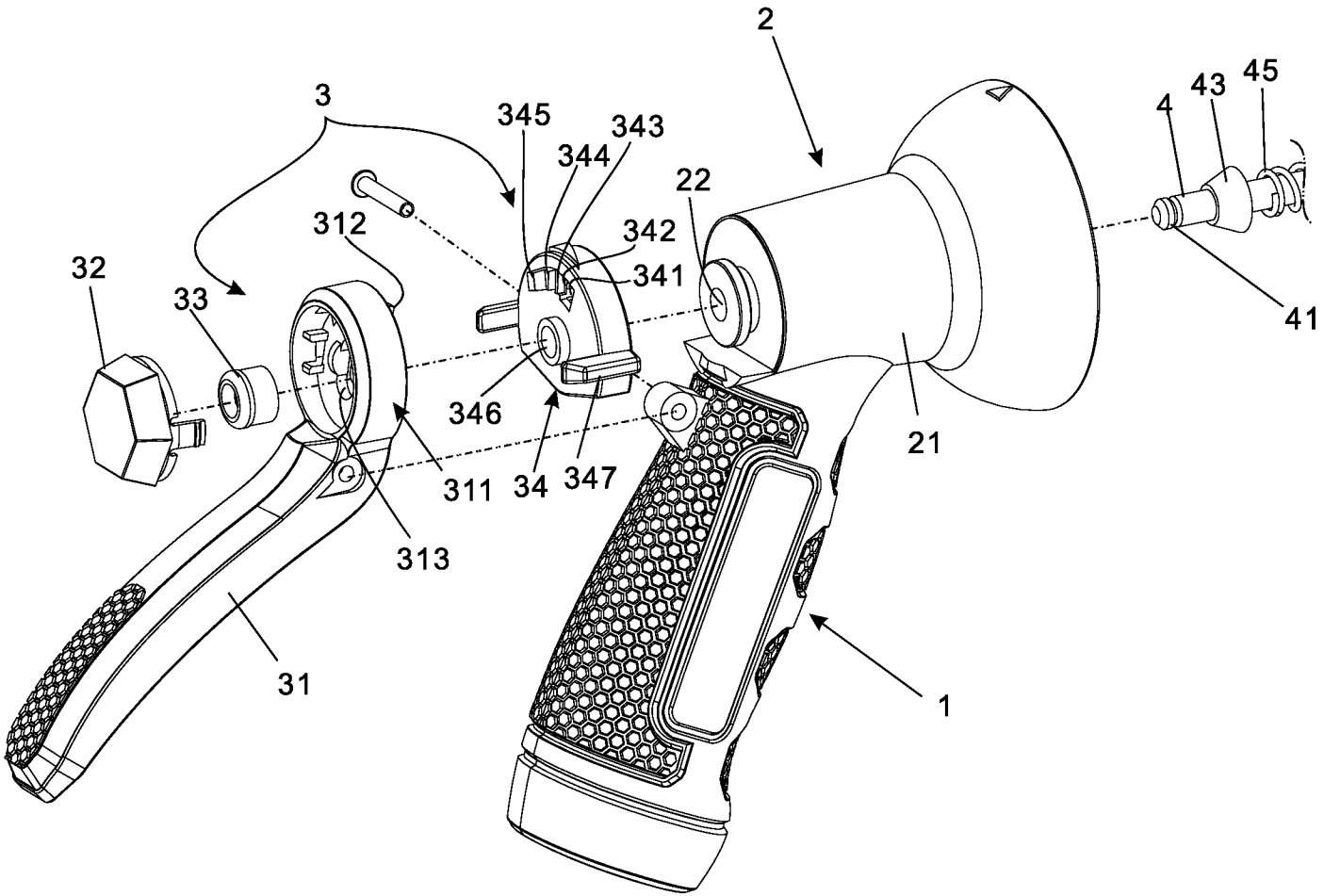
FIG. 1 is an explosive view of an embodiment according to the present invention.
Figure 2:
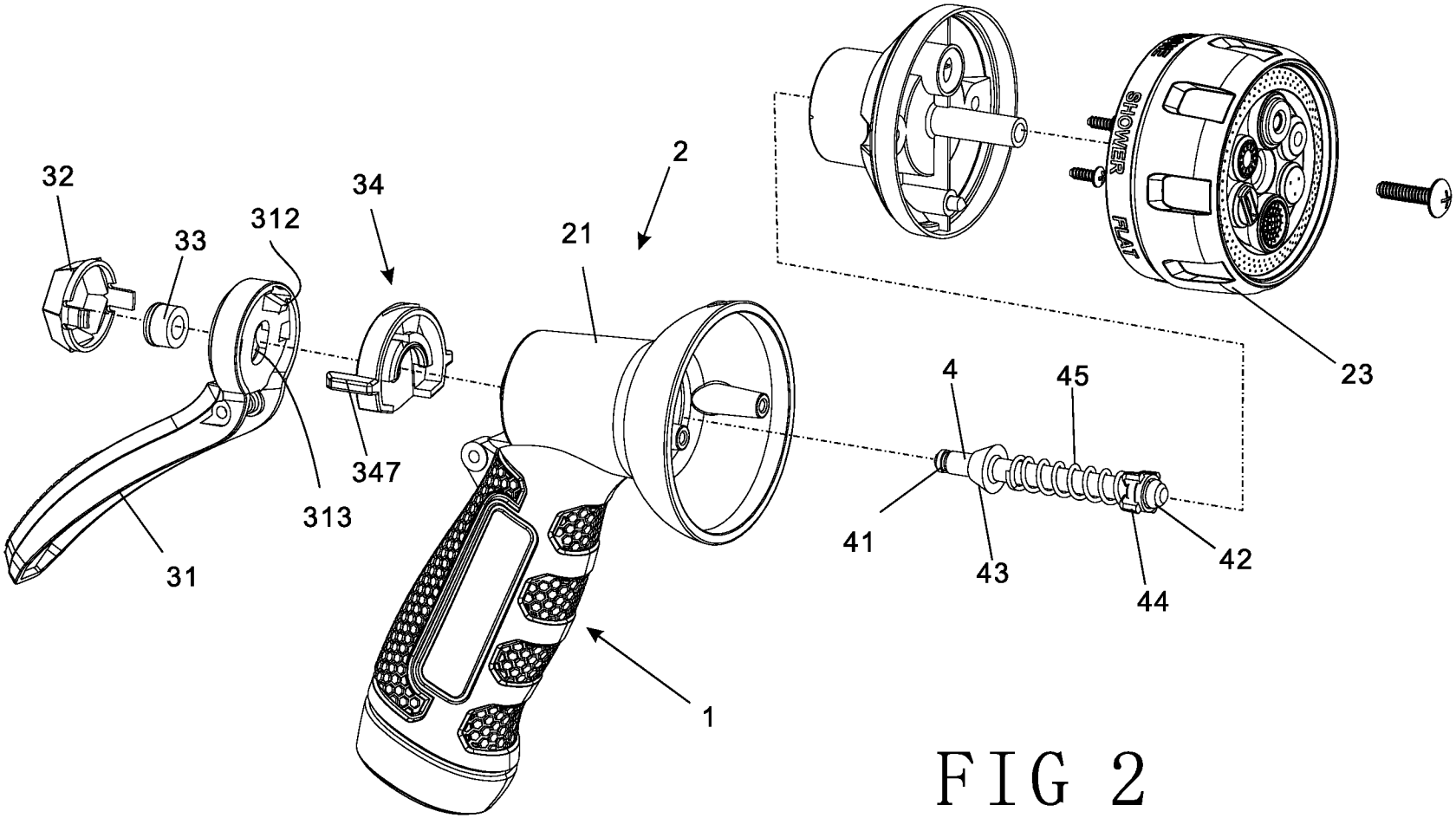
FIG. 2 is another explosive view of an embodiment according to the present invention viewed from another angle.
Figure 3:
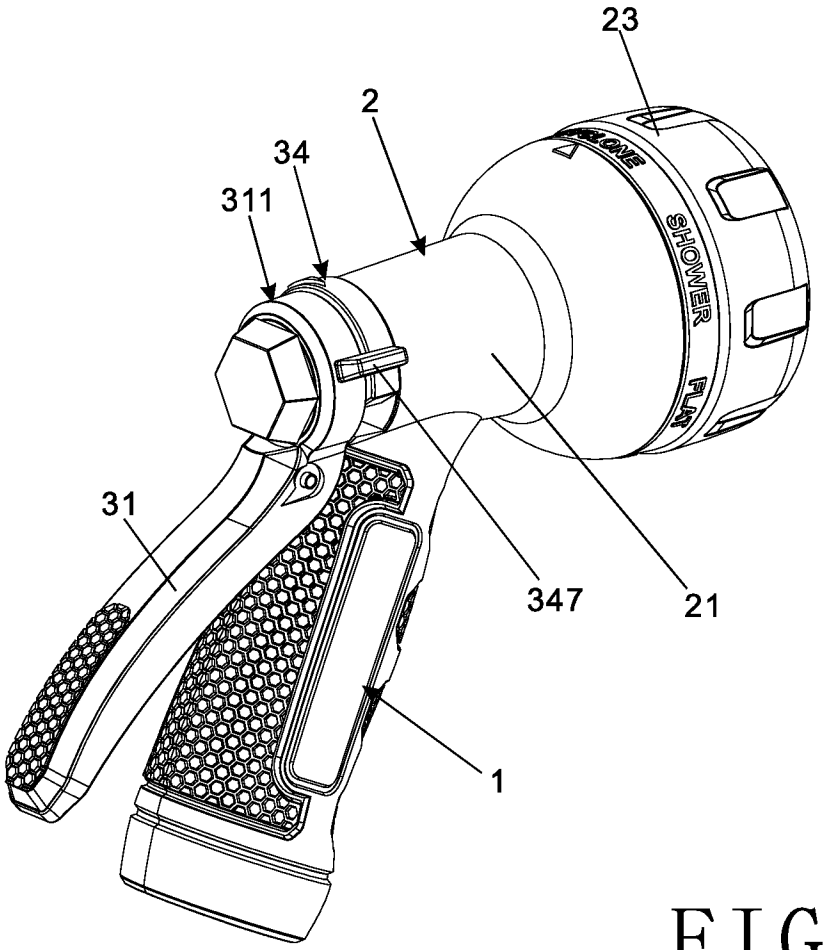
FIG. 3 is a perspective view of an embodiment according to the present invention.
Figure 4:
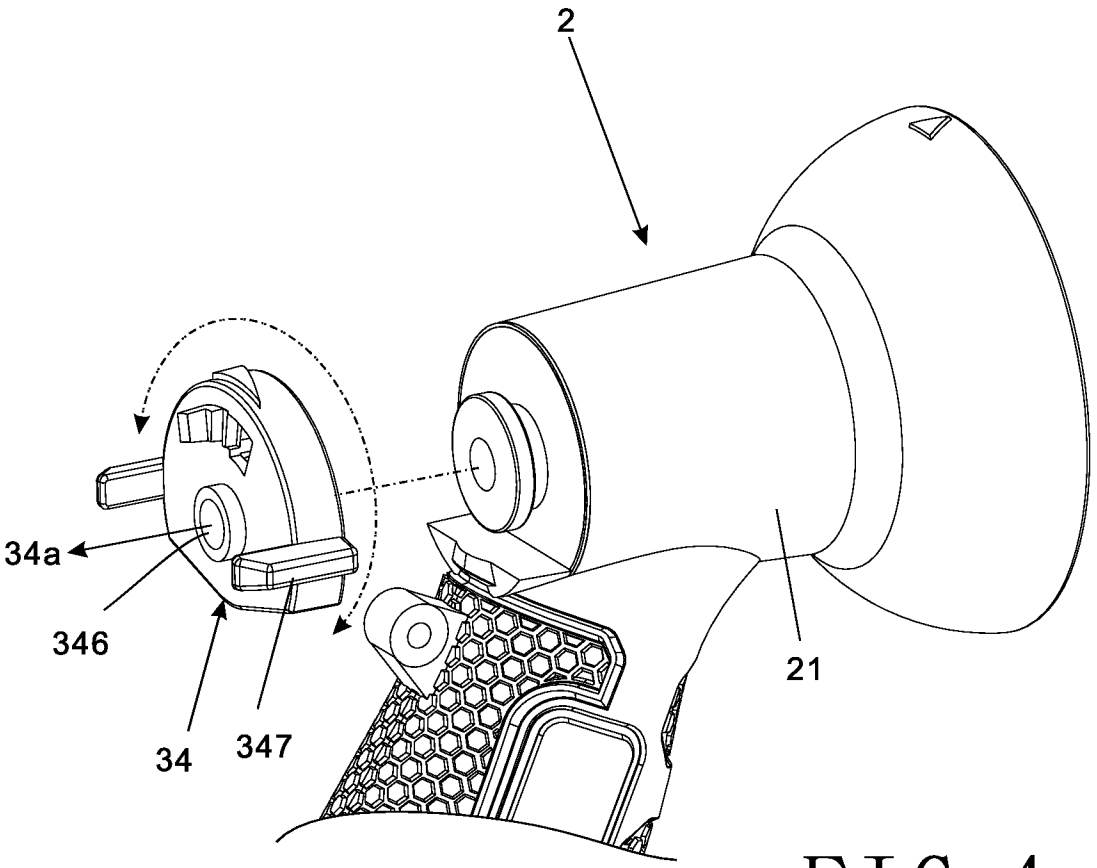
FIG. 4 is a partial enlarged view of an embodiment showing a rotary control member assembled on a tail end of the pipe portion and rotated around a central line of the rotary control member according to the present invention.

The first end 41 of the movable valve stem 4 is inserted through the through hole 22, the axial hole 346 of the rotary control member 34, and the insertion hole 313 of the assembly end 311 to be fixed on and connected to the assembly end 311 by the limit member 33. Thereby the first end 41 of the movable valve stem 4 is limited on the assembly end 311, without being released from the assembly end 311 while the assembly end 311 is closed by the cover part 32. As shown in FIG. 4, the rotary control member 34 is disposed on the tail end of the pipe portion 2 and able to be rotated around a central line 34*a* for selecting one of the step-like parts or the slot 341 which is corresponding to the positioning part 312. In this embodiment, a limited rotation around the movable valve stem 4 is carried out yet this is not used to limit the features of the rotary control member 34. The positioning part 312 is abutting against one of the step-like parts of the rotary control member 34 being selected by rotation of the rotary control member 34. Thereby the movable valve stem 4 can be adjusted to move forward or backward axially and the second end 42 of the movable valve stem 4 is further adjusted slightly to be away from the passage 231. Thus the first chamber 211 is communicating with the second chamber 232 for control of the amount of water coming out from the water outlet channel. According to the selected step-like part which the positioning part 312 is abutting against, the amount of the water outflow sprayed out from the pipe portion 2 at the respective stages is determined.

Figure 5:
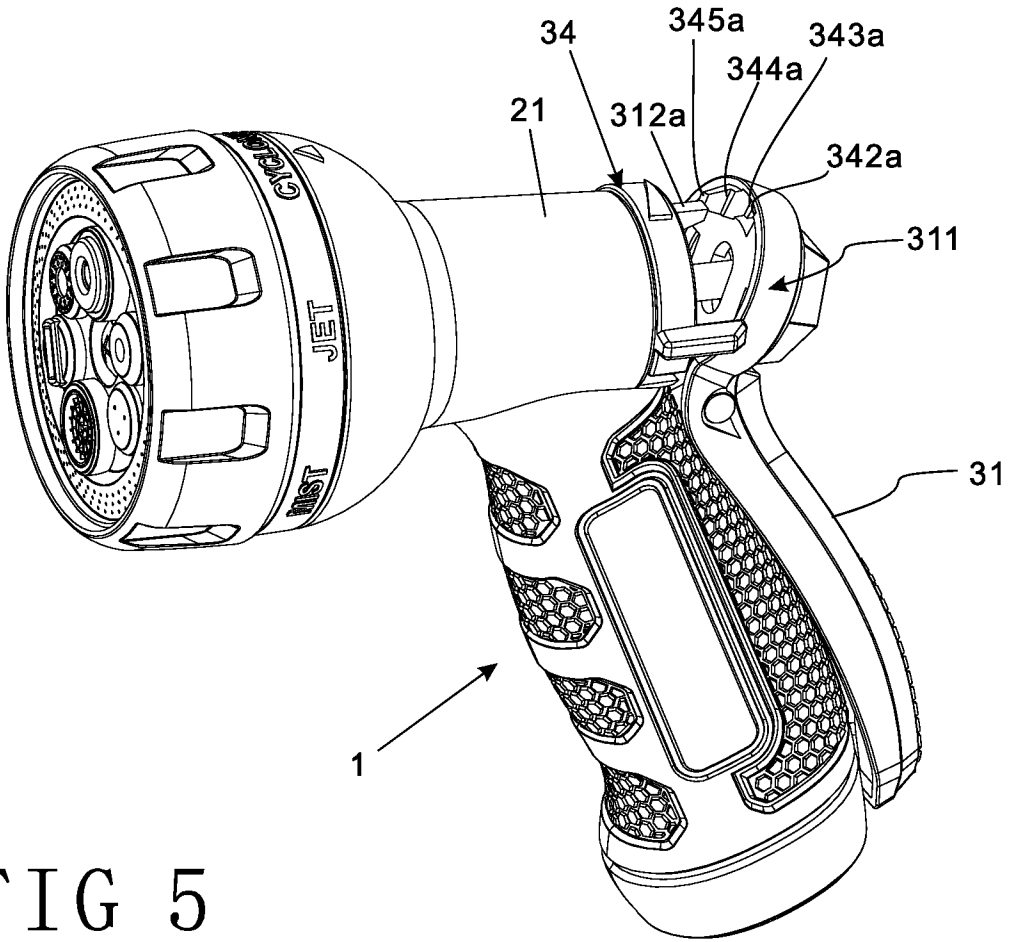
FIG. 5 is a perspective view of another embodiment according to the present invention.
Figure 6:
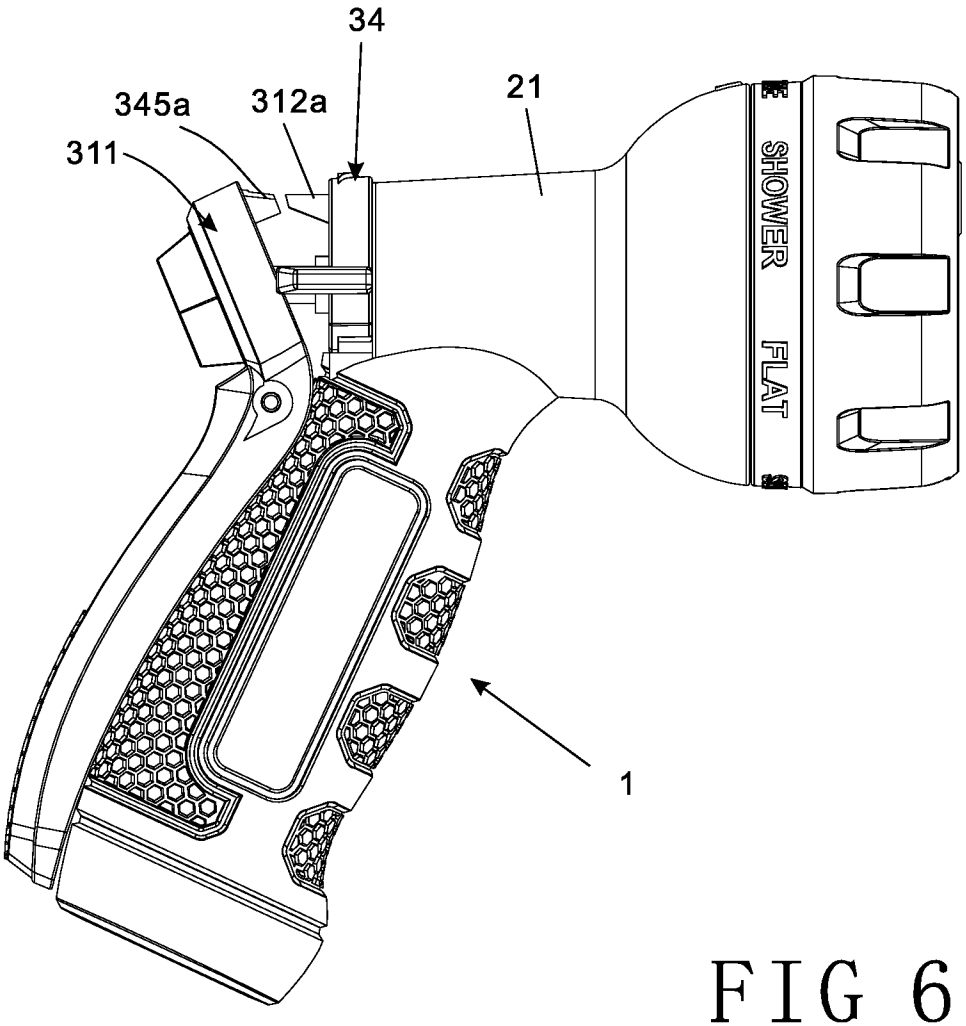
FIG. 6 is a side view of the embodiment in FIG. 5 according to the present invention.

As shown in FIG. 5 and FIG. 6, another embodiment is revealed. In this embodiment, the step-like parts are arranged at the assembly end 311 while the positioning part 312*a* is disposed on the rotary control member 34. The step-like parts include a first step-like part 342*a*, a second step-like part 343*a*, a third step-like part 344*a* and a fourth step-like part 345*a*. The positioning part 312*a* of the rotary control member 34 is abutting against one of the step-like parts (the first step-like part 342*a*, the second step-like part 343*a*, the third step-like part 344*a* and the fourth step-like part 345*a*) correspondingly. The step-like part 342*a*, 343*a*, 344*a*, 345*a* is selected by rotation of the rotary control member 34. Thereby the movable valve stem 4 is adjusted to move forward/or backward axially and the second end 42 of the movable valve stem 4 is further adjusted slightly to be away from the passage 231. Thus the first chamber 211 is communicating with the second chamber 232 for control of the amount of water coming out from the water outlet channel. According to the selected step-like part which the positioning part 312*a* is abutting against, the amount of water sprayed out from the pipe portion 2 at the respective stages is determined and regulated continuously.

Referring to FIG. 7-11, the water spray gun is operated as following while in use. Referring to FIG. 7, the water spray gun is in a closed state, without any water outflow. The press part 31 is pressed to move the movable valve stem 4 and the push part 347 is pushed for adjusting and rotating the rotary control member 34. The rotary control member 34 is rotated so that the positioning part 312 is moved into the slot 341 correspondingly. Then the press part 31 is released and the movable valve stem 4 is also moved so that the passage 231 is sealed by the second end 42 of the movable valve stem 4. Thereby water in the first chamber 211 will not flow into the second chamber 232.

Figure 8:
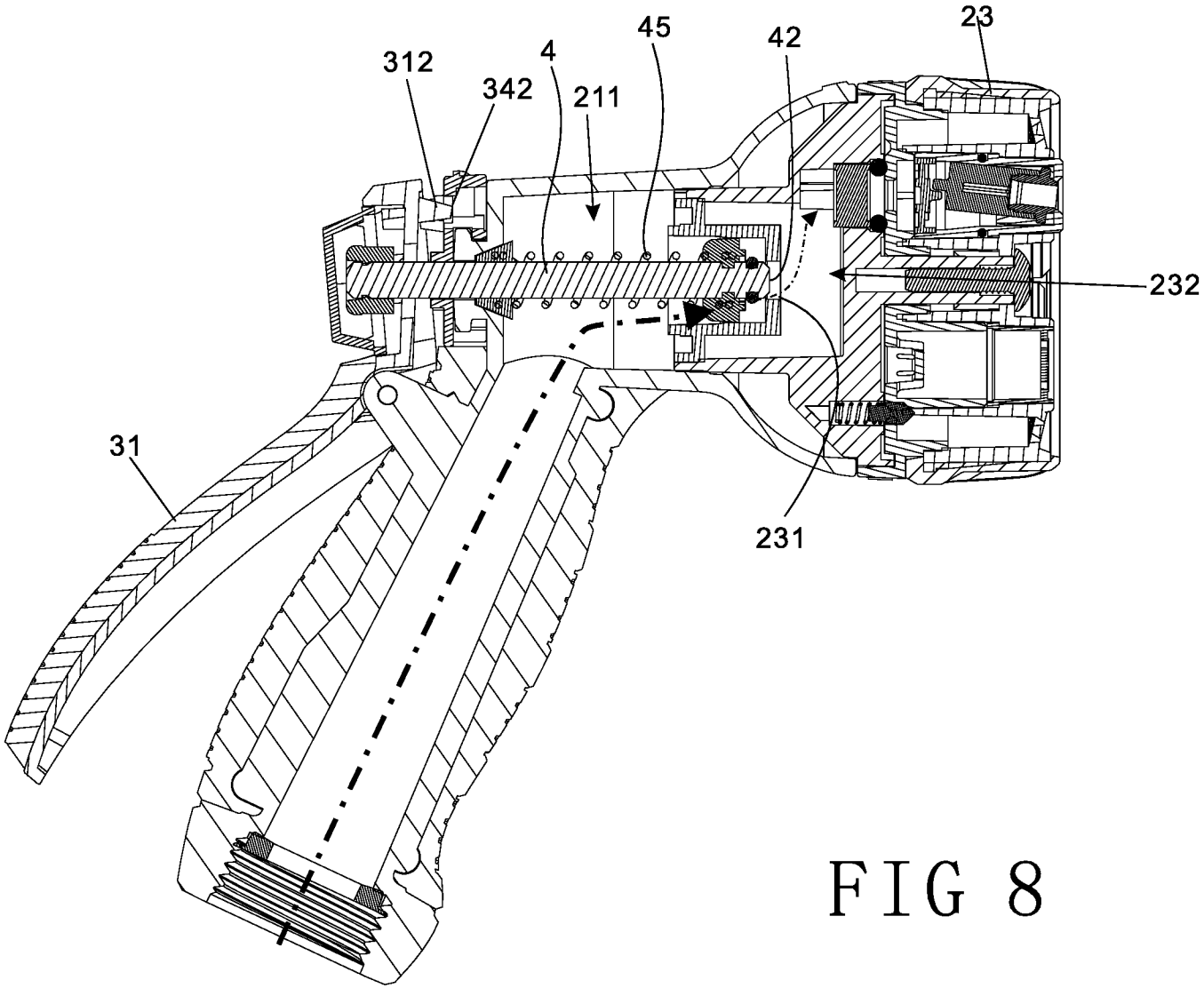
FIG. 8 is a sectional view of an embodiment in which an outflow of water is at the first stage according to the present invention.

In this embodiment, there are four stages of the continuous outflow of the water divided according to the amount of the water flowing from the spray water gun. The FIG. 8 shows the first stage outflow of the water. According to the amount of water users need to spray out, the press part 31 is pressed to move the movable valve stem 4 so that the second end 42 of the movable valve stem 4 is away from the passage 231 and the water in the first chamber 211 is flowing into the second chamber 232. The press part 31 is pressed to move the movable valve stem 4 and the push part 347 is pushed for adjusting and rotating the rotary control member 34 so as to make the positioning part 312 of the press part 31 abut against the first step-like part 342 correspondingly. At the moment, the movable valve stem 4 is moved backward axially by the assembly end 311 of the press part 31 so that the second end 42 of the movable valve stem 4 is gradually moved away from the passage 231. Then the press part 31 is released and the movable valve stem 4 is pulled forward a bit by the spring 45 of the movable valve stem 4 so that the positioning part 312 is abutting against the first step-like part 342 and the rotary control member 34 is temporarily positioned. Now there is a little gap formed between the assembly end 311 of the press part 31 and the rotary control member 34 due to the positioning part 312 abutting against the first step-like part 342. The second end 42 of the movable valve stem 4 is a bit away from the passage 231 and there is a small amount of water at the first stage (limited amount of water) flowing from the first chamber 211 to the second chamber 232. Lastly the water in the second chamber 232 is sprayed out through the spray head 23.

Figure 9:
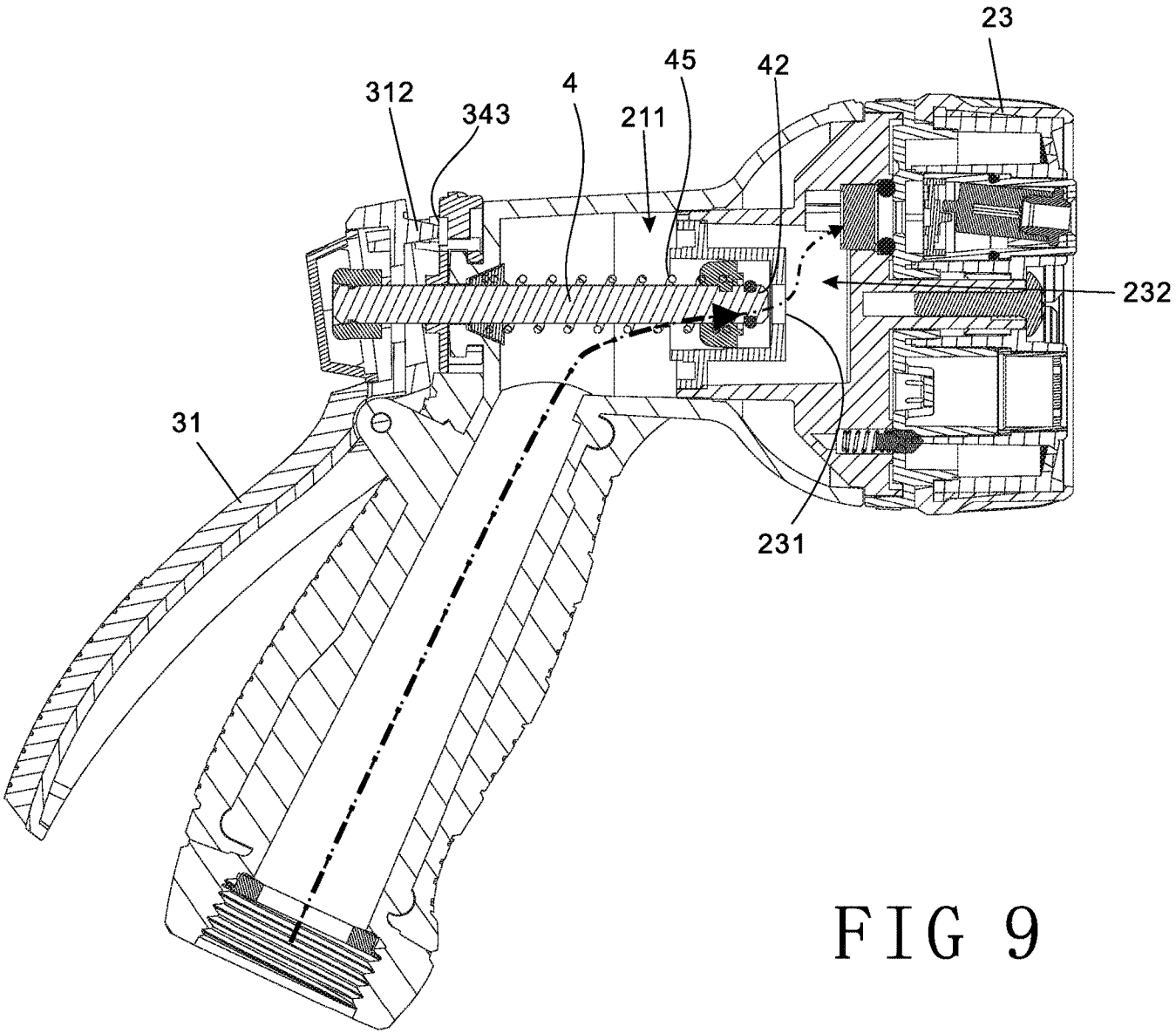
FIG. 9 is a sectional view of an embodiment in which an outflow of water is at the second stage according to the present invention.

Referring to FIG. 9, the second stage outflow of the water is disclosed. The same as the settings and operations at the first stage, the press part 31 is pressed to move the movable valve stem 4 and the push part 347 is pushed for adjusting and rotating the rotary control member 34 to make the positioning part 312 abut against the second step-like part 343. Now the movable valve stem 4 is moved backward axially by the assembly end 311 of the press part 31 so that the second end 42 of the movable valve stem 4 is moved a bit further away from the passage 231. Then the press part 31 is released and the movable valve stem 4 is pulled forward a bit by the spring 45 of the movable valve stem 4 so that the positioning part 312 is abutting against the second step-like part 343 and the rotary control member 34 is temporarily positioned. At the moment, the gap between the assembly end 311 of the press part 31 and the rotary control member 34 is larger than before. Thus the waterway space is increased and the quantity/volume of the fluid passed through per unit of time is further increased. At the second stage, a medium amount of water is flowing from the first chamber 211 to the second chamber 232 and then flowing out of the spray head 23.

Figure 10:
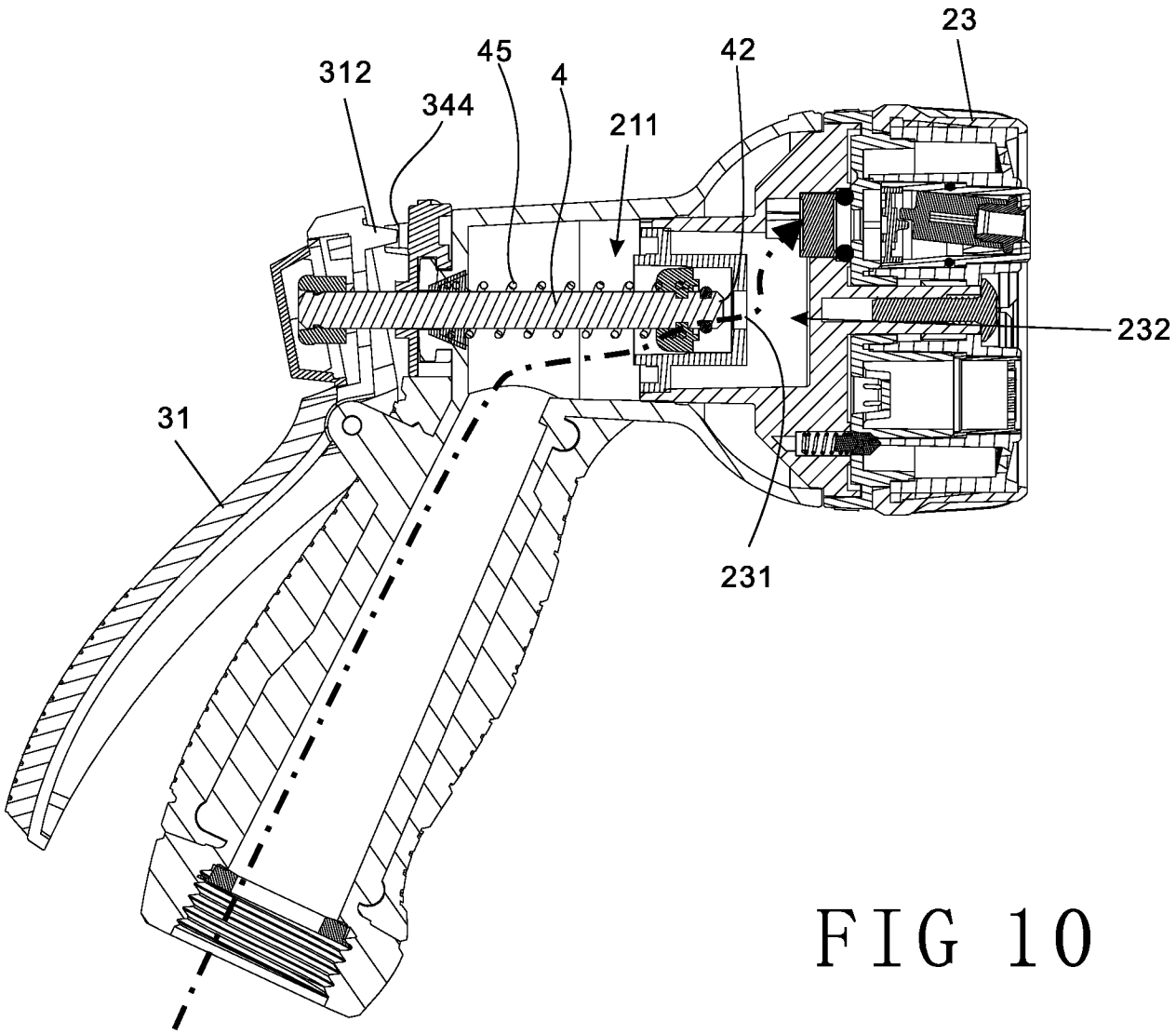
FIG. 10 is a sectional view of an embodiment in which an outflow of water is at the third stage according to the present invention.

The FIG. 10 shows the third stage outflow of the water. The same as the settings and operations at the second stage, the press part 31 is pressed to move the movable valve stem 4 and the push part 347 is pushed for adjusting and rotating the rotary control member 34 to make the positioning part 312 abut against the third step-like part 344. Now the movable valve stem 4 is moved backward axially by the assembly end 311 of the press part 31 so that the second end 42 of the movable valve stem 4 is moved further away from the passage 231. Then the press part 31 is released and the movable valve stem 4 is pulled forward a bit by the spring 45 of the movable valve stem 4 so that the positioning part 312 is abutting against the third step-like part 344 and the rotary control member 34 is temporarily positioned. At the moment, the gap between the assembly end 311 of the press part 31 and the rotary control member 34 is getting larger than before. Thus the waterway space is increased and the quantity/volume of the fluid passed through per unit of time is further increased. At the third stage, a large amount of water is flowing from the first chamber 211 to the second chamber 232 and then flowing out of the spray head 23.

Figure 11:
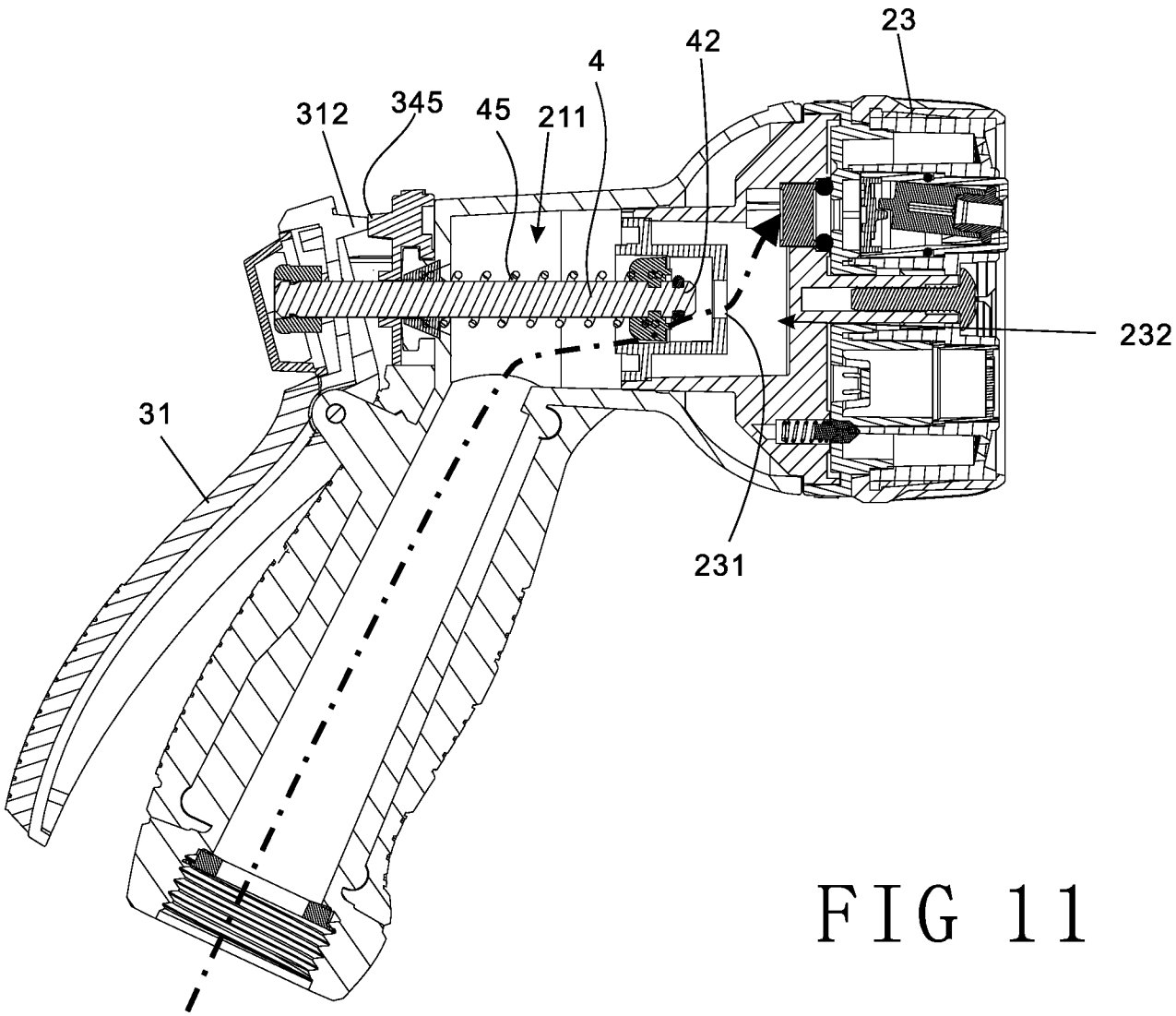
FIG. 11 is a sectional view of an embodiment in which an outflow of water is at the fourth stage according to the present invention.

Referring to FIG. 11, the fourth stage outflow of the water is revealed. The same as the settings and operations at the third t stage, the press part 31 is pressed to move the movable valve stem 4 and the push part 347 is pushed for adjusting and rotating the rotary control member 34 to make the positioning part 312 abut against the fourth step-like part 345. Now the movable valve stem 4 is moved backward axially by the assembly end 311 of the press part 31. The press part 31 is released and the movable valve stem 4 is pulled forward a bit by the spring 45 of the movable valve stem 4 so that the positioning part 312 is abutting against the fourth step-like part 345 and the rotary control member 34 is temporarily positioned. At the moment, the gap between the assembly end 311 of the press part 31 and the rotary control member 34 is much larger than before. And the second end 42 of the movable valve stem 4 is moved much further away from the passage 231. Thus the waterway space is increased and the quantity/volume of the fluid passed through per unit of time is further increased. At the fourth stage, a very large amount of water is flowing from the first chamber 211 to the second chamber 232 and then flowing out of the spray head 23.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A water spray gun for control of an outflow of water and adjustment of the amount of the outflow comprising:

a pipe portion which includes a pipe body with a water outlet channel, a through hole and a spray head while the water outlet channel having a partition which is provided with a passage and used for separating the water outlet channel into a first chamber and a second chamber;

a handle portion connected to the pipe portion and provided with a water inlet channel which is communicating with the water outlet channel of the pipe portion;

a movable valve stem mounted in the water outlet channel and including a first end, a second end formed by extension of the first end and having a matching shape to that of the passage for being mounted into the passage to close the passage, a sleeve part disposed on the first end, an enlarged member arranged close to the second end and the second end projecting from the enlarged member, and a spring set between the first end and the second end; and a control device which is disposed on a connection between the pipe portion and the handle portion;

wherein the control device includes a press part, a limit member and a rotary control member; the press part is composed of an assembly end, a positioning part and an insertion hole mounted on the assembly end while the rotary control member comprises a slot and a plurality of step-like parts;

wherein the first end of the movable valve stem is inserted through the through hole, the axial hole of the rotary control member and mounted into the assembly end and then being connected to the assembly end by the limit member; thereby the first end of the movable valve stem is attached to the assembly end, without being released from the assembly end; wherein the rotary control member is disposed on a tail end of the pipe portion and able to be rotated around a central axis of the rotary control member; wherein the positioning part is disposed on one side of the assembly end of the press part facing the rotary control member and is abutting against one of the step-like parts of the rotary control member being selected by rotation of the rotary control member; the rotary control member is able to be rotated for selecting one of the step-like parts or the slot which is corresponding to the positioning part; thereby the movable valve stem can be adjusted to move forward or backward axially and the second end of the movable valve stem is further adjusted slightly to be away from the passage; thus the first chamber is communicating with the second chamber for control of the outflow of water and adjustment of the amount of the outflow; wherein the amount of the outflow from the pipe portion at different stages is determined according to the selected step-like part of the rotary control member the positioning part abuts against.

2. The device as claimed in claim 1, wherein a height of the respective step-like parts is increased in turn.

3. A water spray gun for control of an outflow of water and adjustment of the amount of the outflow comprising:

a pipe portion which includes a pipe body with a water outlet channel, a through hole and a spray head while the water outlet channel having a partition which is provided with a passage and used for separating the water outlet channel into a first chamber and a second chamber;

a movable valve stem which is mounted in the water outlet channel and including a first end, a second end formed by extension of the first end and having a matching shape to that of the passage for being mounted into the passage to close the passage, a sleeve part disposed on the first end, an enlarged member arranged close to the second end and the second end projecting from the enlarged member, and a spring set between the first end and the second end;

a handle portion connected to the pipe portion and provided with a water inlet channel which is communicating with the water outlet channel of the pipe portion; and a control device disposed on a connection between the pipe portion and the handle portion and having a limit member, a rotary control member provided with a slot and a plurality of step-like parts, and a press part composed of an assembly end, a positioning part and an insertion hole mounted on the assembly end;

wherein the first end of the movable valve stem is inserted through the through hole, the axial hole of the rotary control member and mounted into the assembly end, and then being connected to the assembly end by the limit member; thereby the first end of the movable valve stem is attached to the assembly end, without being released from the assembly end; wherein the rotary control member is disposed on a tail end of the pipe portion and able to be rotated around a central axis of the rotary control member; wherein the positioning part is disposed on one side of the assembly end of the press part facing the rotary control member and is abutting against one of the step-like parts of the rotary control member being selected by rotation of the rotary control member; the rotary control member is able to be rotated for selecting one of the step-like parts or the slot which is corresponding to the positioning part; thereby the movable valve stem can be adjusted to move forward or backward axially and the second end of the movable valve stem is further adjusted slightly to be away from the passage; thus the first chamber is communicating with the second chamber for control of the outflow of water and adjustment of the amount of the outflow; wherein the amount of the outflow from the pipe portion at different stages is determined according to the selected step-like part of the rotary control member the positioning part abuts against.

4. The device as claimed in claim 3, wherein a height of the respective step-like parts is increased in turn.

5. A water spray gun for control of an outflow of water and adjustment of the amount of the outflow comprising:

a pipe portion which includes a pipe body with a water outlet channel, a through hole and a spray head while the water outlet channel having a partition which is provided with a passage and used for separating the water outlet channel into a first chamber and a second chamber;

a movable valve stem which is mounted in the water outlet channel and including a first end, a second end formed by extension of the first end and having a matching shape to that of the passage for being mounted into the passage to close the passage;

a handle portion connected to the pipe portion; and a control device disposed on a connection between the pipe portion and the handle portion and having a press part provided with an assembly end pivotally connected to the handle portion, a positioning part, and a rotary control member provided with a slot and a plurality of step-like parts, wherein the first end of the movable valve stem is inserted through the through hole and the control member to be connected to the assembly end, without being released easily; wherein the positioning part is disposed on one side of the assembly end of the press part facing the rotary control member and is abutting against one of the step-like parts of the rotary control member being selected by rotation of the rotary control member; the movable valve stem can be adjusted to move forward or backward axially by the selected step-like part corresponding to the positioning part; wherein the rotary control member is disposed on a tail end of the pipe portion and able to be rotated around a central axis of the rotary control member; the rotary control member is rotated to select one of the step-like parts or the slot corresponding to the positioning part and the second end of the movable valve stem is further adjusted slightly to be away from the passage; thus the first chamber is communicating with the second chamber for control of the outflow of water and adjustment of the amount of the outflow; wherein the amount of the outflow from the pipe portion at different stages is determined according to the selected step-like part of the rotary control member the positioning part abuts against.

6. The device as claimed in claim 5, wherein a height of the respective step-like parts is increased in turn.

* * * * *